US005222096A

United States Patent [19]

Reuter

[11] Patent Number: 5,222,096

[45] Date of Patent: Jun. 22, 1993

[54] INDUCTION FURNACE FOR MELTING AND CASTING PURPOSES WITH AN ENCLOSED CRUCIBLE POT

[75] Inventor: Wolfgang Reuter, Niddatal, Fed. Rep. of Germany

[73] Assignee: Leybold Aktiengesellschaft, Hanau, Fed. Rep. of Germany

[21] Appl. No.: 740,326

[22] Filed: Aug. 5, 1991

[30] Foreign Application Priority Data

Mar. 6, 1991 [DE] Fed. Rep. of Germany ..... 4114683

[51] Int. Cl.[5] ..... H05B 5/00

[52] U.S. Cl. ..... 373/143; 373/142; 373/138; 373/156; 110/267; 110/101 CB; 266/240; 266/245; 432/157; 432/160

[58] Field of Search ..... 373/138, 142, 143, 151, 373/140, 141, 156; 110/101, 267, 327; 266/176, 240, 242, 245, 246; 432/157, 160

[56] References Cited

U.S. PATENT DOCUMENTS 3,939,297 2/1976 Aylard et al. ..... 373/143
3,991,263 11/1976 Folgero et al. ..... 373/143
4,512,801 4/1985 Shigihara et al. ..... 75/58
4,534,730 8/1985 Kraus ..... 432/3
4,658,404 4/1987 Sick et al. ..... 373/143

*Primary Examiner*—Bruce A. Reynolds
*Assistant Examiner*—Tu Hoang
*Attorney, Agent, or Firm*—Felfe & Lynch

[57] ABSTRACT

An induction furnace (1) for melting and casting purposes has a closed crucible pot (2) with a pot bottom (3) and a cover (4), a crucible (6) housed in the crucible pot and surrounded by an induction coil (7), and an ascending tube (9) reaching into the crucible, through which the crucible can be emptied into a casting apparatus by means of gas pressure. To permit continuous operation and measurements and analyses during operation, the ascending tube (9) is fastened exclusively to the pot bottom (3) and connected with a horizontal delivery tube (11) which is brought through a side wall of the pot bottom (3). Furthermore, above a separation seam (24) between pot bottom (3) and cover (4) a turret (39) with a vertical axis of rotation is disposed, which has a charging air lock (26) for charging the crucible (6) with melt material (27) and a measuring chamber (36). The charging air lock and measuring chamber can be connected alternately with an air lock valve (25) which is disposed on the top of the cover (4).

3 Claims, 1 Drawing Sheet

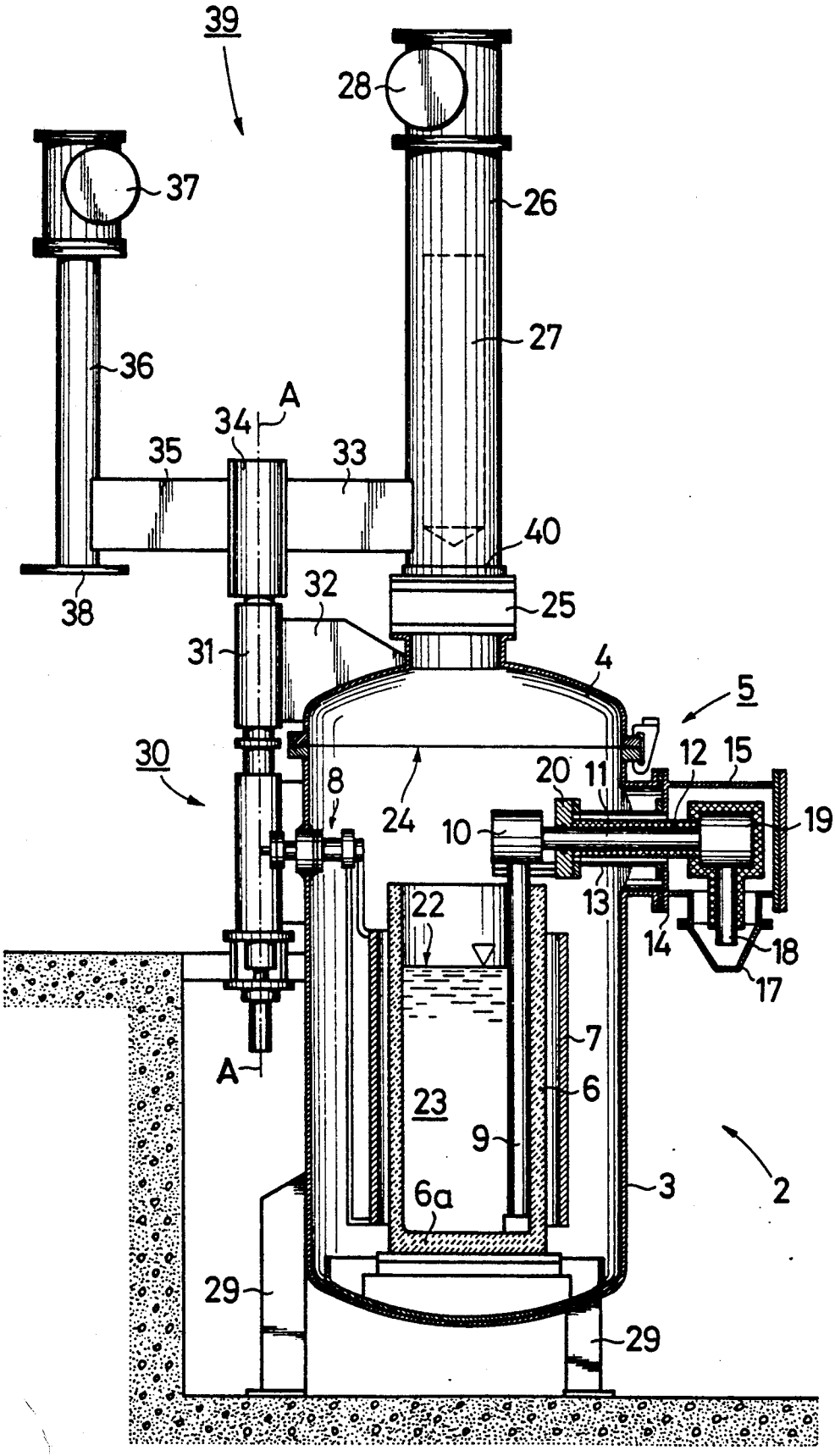
39
28
37
26
27
36
A
34
35
33
40
38
32
25
31
4
5
30
8
24
20
11
12
15
10
19
13
22
14
18
17
7
A
6
23
9
3
2
6a
29
29

INDUCTION FURNACE FOR MELTING AND CASTING PURPOSES WITH AN ENCLOSED CRUCIBLE POT

BACKGROUND OF THE INVENTION

The invention relates to an induction furnace for melting and casting purposes, which has a closed crucible pot with a bottom part and a gas-tight cover releasably superimposed thereon, the whole with a vertical axis. The furnace has a crucible which is contained in the crucible pot and has a likewise vertical axis and is surrounded by an induction coil; and it has an ascending tube reaching into the crucible, through which the crucible can be emptied by gas pressure into a casting apparatus.

The enclosed crucible pot is suitable for operating the crucible under a vacuum and/or protective gas, the protective gas serving, after the melting operation and an appropriate treatment of the melt, to force the latter out of the furnace.

While the teeming of so-called open induction furnaces operated in the atmosphere causes no appreciable problems because the crucible along with the induction coil is mounted for tipping in a furnace frame, teeming presents difficulties in the case of closed induction furnaces, especially vacuum induction furnaces.

Vacuum induction furnaces are known in which a crucible with an induction coil surrounding it is disposed for tipping in a stationary crucible pot. This crucible pot, however, must be of such great dimensions as to provide enough space for the crucible and the induction coil to be tipped. But with the pot volume so large, the teeming time is lengthened and the vacuum pumping expense is increased. Moreover, a complicated coaxial connection between the induction coil and a transformer standing outside of the furnace is needed. This coaxial connection must permit the tipping of the crucible with the induction oil in spite of heavy currents, and likewise the absolutely leak-proof management of the cooling water running through the induction coil.

To remedy these problems vacuum induction furnaces have already been created in which the crucible pot is tippable with all its auxiliary equipment. If in this case the melt has to be teemed with the exclusion of air, such a furnace design calls for a jointed and hermetically sealed teeming spout which involves heat losses from the melt, so that only a considerably overheated melt can be teemed. But this again has harmful effects on the ceramic lining of the teeming spout.

The so-called "ascending tube," which in itself is likewise known, has in this regard created a promising remedy; connecting it to the pot cover or carrying it through the pot cover, however, has greatly hampered any continuous or quasi-continuous operation of the melting and casting furnace. Upon each recharging of the furnace the crucible pot has to be flooded and the pot cover has to be lifted upward to a considerable extent in order to be able to swing the correspondingly long ascending tube over the top edge of the bottom part of the pot.

It is therefore the aim of the invention to devise an induction furnace of the kind described above, which will permit continuous and quasi-continuous operation and permit measurements, analyses and the like to be performed while operation is in progress.

SUMMARY OF THE INVENTION

The solution of the stated problem is accomplished, in accordance with the invention, in the induction furnace described above in that:

a) The ascending tube is fastened only to the bottom part of the pot and is connected to a horizontal delivery tube which is brought through one side wall of the pot bottom, and that b) Above the seam between the pot bottom and the cover there is disposed a turret which has a charging air lock for charging the melting crucible with material for melting, and a measuring chamber; these can be connected alternately to an air lock valve which is disposed on the top of the cover.

In the system according to the invention, the ascending tube, charging air lock and measuring chamber do not interfere with one another. The subject matter of the invention thus advantageously permits a continuous or quasi-continuous method of operating the furnace, i.e., material, that is, both the raw material and purifying agents, additives or alloy components, can be added through the charging air lock in the given time intervals. While the melting is in progress the measuring chamber can be coupled to the crucible pot by raising it, turning it around and lowering it again, for the purpose of performing analyses and taking samples as needed. The measuring chamber serves to accommodate and to lower probes, sampling cups, pyrometers and the like, for this purpose. An air lock valve affixed to the cover provides for the sealing off of the furnace atmosphere.

As soon as a charge has the necessary composition and temperature, an appropriate gas pressure corresponding to the barometric head can be applied to remove it through the ascending tube, the horizontal delivery tube and any additional connecting tubes that may be present. Immediately after teeming, which can also be performed in controlled portions, the induction furnace can be charged with fresh materials without flooding, so that melting cycle follows melting cycle.

An especially advantageous embodiment of the invention is characterized by the fact that a supporting structure is fastened laterally on the crucible pot, which has a first raising and turning system for the turret and a second raising and turning system for the cover, in a coaxial arrangement. In this manner the charging air lock and measuring chamber can be swung around both independently of the pot cover and together with it. Furthermore, the expense involved is extraordinarily low.

It is furthermore advantageous for the horizontal delivery tube to be thermally insulated and held in a first pipe connection provided laterally on the pot bottom, and adjoined by a second pipe connection having a downwardly directed teeming spout for the melt. This teeming spout can be connected to a teeming pit in which one or more teeming molds are situated, which can likewise be kept under a vacuum and/or protective gas.

BRIEF DESCRIPTION OF THE DRAWING

An embodiment of the subject matter of the invention will be further explained below with the aid of the single drawing which shows a partial vertical section along the vertical axis of the crucible pot.

DESCRIPTION OF THE PREFERRED EMBODIMENT

In the FIGURE there is depicted a vacuum induction furnace 1, which has an enclosed crucible pot 2 consisting of a pot bottom 3 and a cover 4 joined together hermetically by a releasable junction 5, a so-called flange connection. In the bottom part 3 of the pot is a melting crucible 6 which is concentrically surrounded by an induction coil 7. The induction coil 7 is connected by a coaxial connection 8 to a power supply system on the outside (not shown), for example to a medium-frequency generator.

In the immediate vicinity of the side wall of the melting crucible 6 there is an ascending tube 9 which runs nearly to the bottom 6a of the crucible 6. The ascending tube 9 is connected by a head 10 to a horizontal delivery tube 11 which is surrounded by an insulating sleeve 12 and held in a pipe nipple 13 fastened laterally to the pot bottom 3. The fastening is performed by a flat ring 14 bearing on its exterior side a second pipe nipple 15 which is closed off in the axial direction by a flange plate 16. The pipe nipple 15 has a downwardly pointing teeming spout 17 in which is a vertical delivery tube 18 which is connected by a second head 19 to the horizontal delivery tube 11.

The inner end of the pipe nipple 13 bears a flange connection 20 to which the inner head 10 of the ascending tube 9 is fastened by a bracket 21.

An internal pressure, produced in the crucible pot 2 by a compressed gas source not represented, acts on the melt surface 22 and forces the melt 23 through the ascending tube 9, the horizontal delivery tube 11 and the vertical delivery tube 18 into a teeming mold not shown.

The pot bottom 3 and cover 4 are joined together at the joint 24. On the cover 4 is an air lock valve 25, and on the latter there is releasably mounted a charging air lock 26 in which material to be melted 27, represented in broken lines, in the form of a cylindrical ingot, is contained. At the upper end of the charging air lock 26 is a motor 28 by which the material 27 can be lowered into the crucible 6 by a hoisting mechanism not represented.

The crucible pot 2 rests on columns 29. A supporting structure 30 is mounted laterally on the pot bottom 3 and has a first raising and turning system 31 for the cover 4 to which it is connected by a boom 32.

The charging air lock 26 is connected by a second boom 33 to a second raising and turning system 34 which is connected on the side diametrically opposite the boom 33 to another boom 35 on which the measuring chamber 36 is located. The measuring chamber 36, like the charging air lock 26, is in the form of a slender cylinder, but is made smaller in diameter. At the upper end of the measuring chamber 36 is another motor 37 with which meter probes and the like can be lowered into the melt 23 by a likewise not represented raising and lowering system, when a bottom flange 38 is connected to the air lock valve 25.

The charging air lock 26 and the measuring chamber 36, in connection with the raising and turning system 34 together with the two booms 33 and 35, form a so-called turret 39 having an axis of rotation A—A which coincides with the axis of the supporting structure 30. It is to be understood that the charging air lock 26 has at its bottom end a flange 40, which in the position in which it is shown is connected hermetically to the air lock valve 25. By actuating the second raising and turning system 34 the charging air lock 26 and measuring chamber 36 can be connected alternately to the air lock valve 25.

It is easily seen that a very compact structure results from the coaxial arrangement of the two raising and turning systems 31 and 34, and that furthermore the turret 39 can be turned either with or without the cover 4. For the raising movements, hydraulic cylinders are disposed inside of the supporting structure 30, but they have not been represented, for the sake of simplicity.

Several ingots as the material 27 to be melted can be placed successively into the crucible 6 and also successively melted. It is possible at virtually any intervals of time, after closing the air lock valve 25, to couple the measuring chamber 36 to the air lock valve 25 and, after opening the valve, to lower a probe into the melt. When the melt 23 has the required temperature and composition, pressure corresponding to the barometric head between the bottom 6a of the crucible 6 and the horizontal delivery tube 11 is produced in the crucible pot 2 by a compressed gas (inert gas) source not represented. The melt can be removed in portions by appropriate pulsed operation of the compressed gas source. The teeming chamber and molds which are disposed underneath the teeming spout 17 and are connected hermetically with the latter, have been omitted from the drawing for the sake of simplicity.

I claim:

1. Induction furnace for melting and casting purposes comprising:

a closed crucible pot with a pot bottom and a cover with a seam therebetween and superimposed gas-tight through a releasable junction, all with a vertical axis, a crucible contained in the crucible pot with a vertical axis, which is surrounded by an induction coil, and a vertical ascending tube reaching into the crucible, through which the crucible is emptied by means of gas pressure into a casting apparatus, the ascending tube being fastened exclusively to the pot bottom and a horizontal delivery tube which is brought through a side wall of the pot bottom and which is connected with the ascending tube, a lock valve which is disposed on the top of the cover, and above the seam between the pot bottom and the cover a rotatable turret with a vertical axis of rotation being disposed, which has a charging lock for charging the crucible with melt material and a measuring chamber, which are connectable alternately to the lock valve.

2. Induction furnace according to claim 1, which includes a supporting structure laterally fastened on the crucible pot, the supporting structure in a coaxial arrangement having both a first raising and turning system for the turret as well as a second raising and turning system for the cover.

3. Induction furnace according to claim 1, which includes a first pipe nipple mounted laterally on the pot bottom and holding a horizontal delivery tube thermally insulated, and which includes a second pipe nipple with a downwardly pointing teeming spout for the melt.

* * * * *